US006070866A

United States Patent [19]

Wepfer

[11] Patent Number: 6,070,866

[45] Date of Patent: Jun. 6, 2000

[54] APPARATUS FOR THE CHARGING OF A PROCESSING LINE FOR PRINTED SHEETS

[75] Inventor: Werner Wepfer, Frauenfeld, Switzerland

[73] Assignee: Grapha-Holding AG, Switzerland

[21] Appl. No.: 08/903,379

[22] Filed: Jul. 30, 1997

[30] Foreign Application Priority Data

Jul. 30, 1996 [CH] Switzerland ..... 1889/96

[51] Int. Cl.[7] ..... B65H 5/00

[52] U.S. Cl. ..... 271/10.11; 271/11; 271/100; 271/101; 271/277

[58] Field of Search ..... 271/11, 100, 101, 271/277, 10.11

[56] References Cited

U.S. PATENT DOCUMENTS

| | | | |
|---|---|---|---|
| 4,180,255 | 12/1979 | Himmel | 271/277 X |
| 4,290,595 | 9/1981 | Thünker . | |
| 4,358,100 | 11/1982 | Muller | 271/100 X |
| 5,366,214 | 11/1994 | Sato | 271/100 |
| 5,586,756 | 12/1996 | Chang | 271/100 X |

FOREIGN PATENT DOCUMENTS

| | | | |
|---|---|---|---|
| 3935 372 A1 | 10/1989 | Germany . | |
| 61439 | 4/1985 | Japan | 271/11 |
| 641 112 A5 | 10/1979 | Switzerland . | |

*Primary Examiner*—Christopher P. Ellis
*Assistant Examiner*—Richard Ridley
*Attorney, Agent, or Firm*—Venable; George H. Spencer; Robert Kinberg

[57] ABSTRACT

An apparatus for the charging a processing line with printed sheets is comprised of a conveying device which pulls off the printed sheets from a bottom side of a stack, with a separating apparatus that partially lifts off the printed sheet to be pulled off from the stack being arranged upstream of the conveying device. The separating apparatus positions the lifted off printed sheet in an open gripper arrangement that rotates with the conveying device and releases it, once the printed sheet has been gripped by the gripper arrangement, so that the printed sheet can be pulled out of the magazine without deflection.

11 Claims, 6 Drawing Sheets

APPARATUS FOR THE CHARGING OF A PROCESSING LINE FOR PRINTED SHEETS

CROSS-REFERENCE TO RELATED APPLICATIONS

Priority is claimed with respect to Swiss Application No. 1996 1889/96, filed on Jul. 30, 1996 in Switzerland, the disclosure of which is incorporated herein by reference.

BACKGROUND OF THE INVENTION

The invention relates to an apparatus for charging a processing line with printed sheets, envelopes or similar printed products (hereinafter collectively referred to as printed sheets), wherein the processing line comprises a conveying rotor which pulls off the printed sheets individually from a stack stored in an adjacent printed sheet magazine and against which a printed sheet can be moved on an approximately circular orbit via a gripped edge, with the printed sheet first having been partially lifted off from the stack by means of a separating apparatus. The conveying rotor is provided with at least one multiple-part gripper arrangement controllable into an open or closed position which takes over the printed sheet from the separating apparatus.

An apparatus of this type, often referred to as a feeder, is described and illustrated in Swiss patent document CH-A-641 112. In this known arrangement, the separating apparatus which is configured as a plurality of suction devices, partially lifts off the individual printed sheets from the bottom side of the stack around a pivot axis of the separating apparatus prior to being gripped by the rotating grippers. From this position, the individual printed sheets are gripped by the passing gripper arrangement of the conveying rotor, with a trailing gripper arm of the gripper arrangement moving behind the lifted-off printed sheet in a supporting manner and the leading gripper arm snapping back from an open position of the gripper arrangement toward the trailing gripper arm into a closed position.

During this process, the trailing gripper arm is set to project beyond the perimeter of the conveying rotor and the leading gripper arm is returned to the perimeter of the conveying rotor so that a collision with the printed sheet that was lifted off the stack cannot occur. The printed sheet that is gripped by the gripper arrangement is then pulled forward by way of a force action from under the stack on the pivot shaft of the separating apparatus which bends the printed sheet. The printed sheets may get damaged because of the resulting friction, particularly on the surface that faces the pivot shaft.

Furthermore, the gripper arrangement generates clamping marks that are left on the printed sheets because of the relative movements of the latter with respect to the gripper arrangement.

SUMMARY OF THE INVENTION

It is an object of the present invention to provide an apparatus of the type described at the outset with which the listed drawbacks can be eliminated.

According to the invention, this is accomplished in that the printed sheet, in the position it is lifted off the stack is positioned between a first gripper arm and a trailing second gripper arm of the open gripper arrangement and then is connected with the closed gripper arrangement in a transfer region while being driven approximately in the same direction so that the printed sheet is pulled out of the sheet magazine substantially without deflection.

An embodiment of this type permits a careful or gentle pulling off or pulling out of the individual printed sheets between the magazine bottom and the stack of printed sheets.

In this process, an ideal case of a folded printed sheet is one in which the edge associated with the (last) fold is gripped by the gripper arrangement, but it is not excluded that the printed sheet is gripped at its top or bottom side.

This feeder concept can be applied for the separation of printed sheets, inter alia, for example, for a so-called assembling or collating arrangement, for the production of books by means of perfect binding or thread stitching as well as for the straddled gathering of printed sheets.

The apparatus according to the invention can process folded or unfolded printed sheets.

It is particularly advantageous if the printed sheet that is clamped in the closed gripper arrangement is conveyed approximately at the speed of the latter and is free of the separating apparatus so that different movement components cannot be generated during the gripping process.

To lift the printed sheet off of the stack, the separating apparatus preferably comprises a suction apparatus that can be pivoted around an axis that is parallel to the rotary axis of the conveying rotor, with the suction apparatus being connectable to a vacuum source.

The pivot axis of the suction apparatus and/or the parallel deflection axis of the printed sheet lifted from the stack preferably are disposed approximately in a plane which is formed by a backmost printed sheet seen in the direction of stack formation (i.e., the bottom sheet in the magazine), so that favorable geometric conditions can be created among the moving parts in the transfer region of a printed sheet.

In order to grip the printed sheets in the gripper arrangement in the transfer region largely without friction, it is advantageous if the closed position of the gripper arrangement, seen in the rotating direction of the conveying rotor, is provided in the region of a plane that is formed by the connection of the deflection axis of the printed sheet or the pivot axis of the suction apparatus and the rotary axis of the conveying rotor.

Since the connecting plane between the deflection axis of a printed sheet or the pivot axis of the separating apparatus and the rotary axis of the conveying rotor and/or the closed position of the gripper arrangement can be configured so as to be adjustable, it is possible to change or optimize the geometric conditions in the transfer region.

It is advantageous if the transfer region is formed by the position of the printed sheet as it is lifted from the stack and positioned between the gripper arms of the open gripper arrangement and the closed position of the gripper arrangement on the orbit of the gripper arrangement so as to be able to effect precise settings.

For the purpose of an optimum operation for the transfer of a printed sheet to the gripper arrangement, the connecting plane between the deflection axis of the printed sheet or the pivot axis of the suction apparatus and the rotary axis of the conveying rotor and/or the closed position of the gripper arrangement or the transfer region are advantageously configured so that they can be changed.

Advisably, the transfer region is formed by the position of the printed sheet that was lifted off the stack and is positioned between the gripper arms of the open gripper arrangement and the position at which the gripper arrangement closes on its orbit.

In conjunction with the configuration of favorable geometric conditions in the transfer region, it is useful if the end position of the deflected printed sheet is provided approximately in a region of the plane that is formed by the connection between the deflection axis of the printed sheet or the pivot axis of the separating apparatus and the rotary axis of the conveying rotor, so that a clamping force is created which acts perpendicularly on the printed sheets.

In an apparatus according to the invention having a conveying rotor which, at its circumference, is at least partially drum-shaped for supporting a printed sheet, it is advantageous if the first gripper arm of the gripper arrangement, which holds the printed sheet in the conveying region on the drum-shaped support, is moved toward the conveying rotor in the subsequent open position of the gripper arrangement, in which the first gripper arm projects beyond the drum-shaped support before reaching the transfer region where it moves underneath the printed sheet that was lifted off the stack and subsequently, in the adjoining transfer region, the first gripper arm is moved radially outwardly into the closed position of the gripper arrangement formed with the second gripper arm so that a reliable take-over by the gripper arrangement is ensured.

The apparatus according to the invention is particularly advantageous if the stack boundary plane formed by the backmost printed sheet, seen in the direction of stack formation, or by the magazine bottom is oriented approximately tangentially with respect to the drum-shaped support of the conveying rotor, so that the amount by which a printed sheet is deflected by the separating apparatus can be kept to a minimum.

BRIEF DESCRIPTION OF THE DRAWINGS

In the following, the invention is described by way of an embodiment with reference to the drawing. Reference to the drawing is made expressly with regard to all of the details which are not specified in detail in the description.

DETAILED DESCRIPTION OF THE INVENTION

Figure 1:
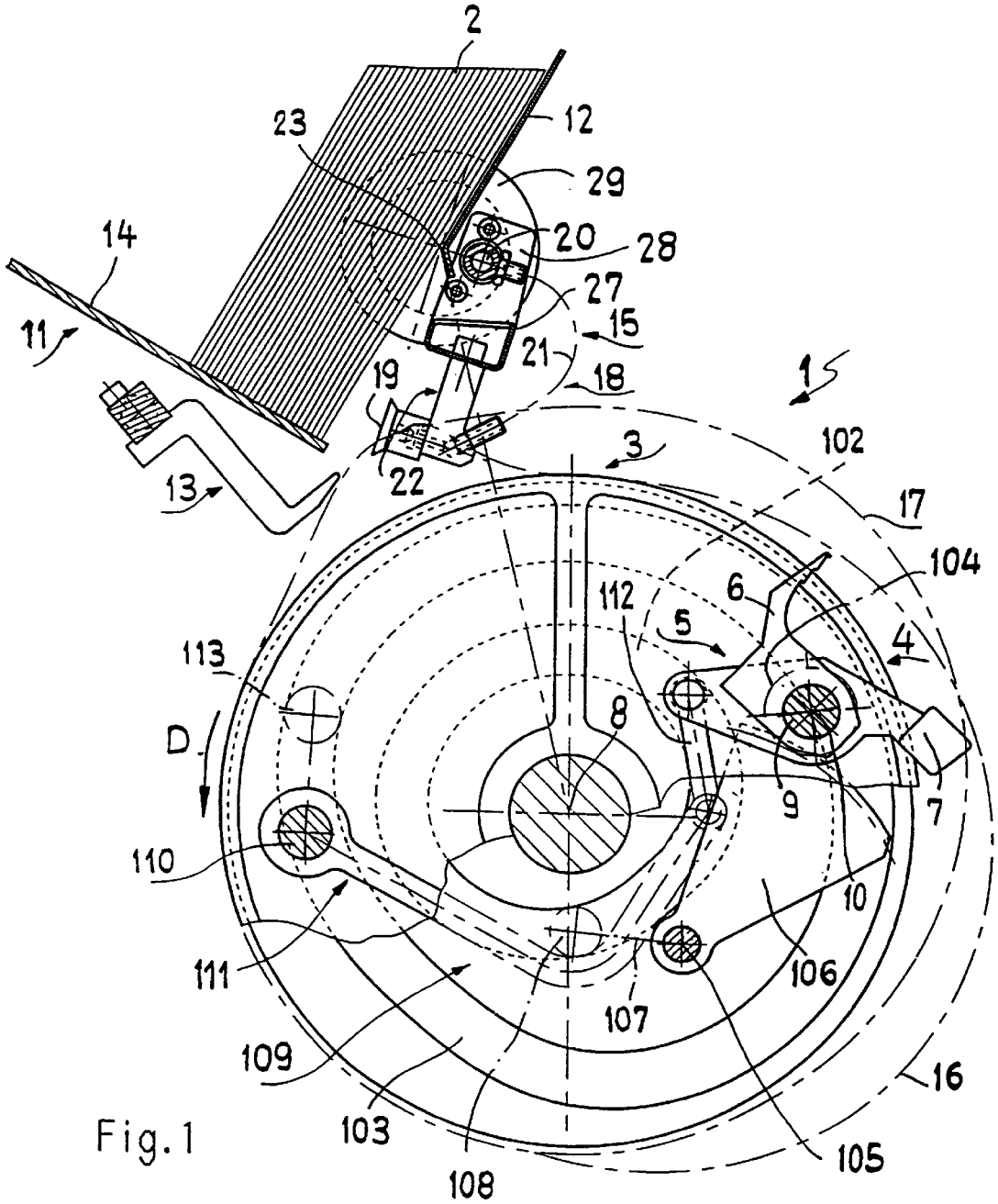
FIG. 1 is a schematic side view of an embodiment of the apparatus according to the invention.

FIGS. 1 to 5 illustrate an apparatus 1, referred to as a printed sheet feeder, for the charging of a processing line with folded or unfolded printed sheets. Apparatus 1 comprises a driven conveying rotor 3, having a rotary axis 8, with one or several gripper arrangements 4, which are disposed on the circumference and which extend across at least approximately the width (i.e. parallel to rotary axis 8) of conveying rotor 3. A gripper arrangement usually comprises two gripping devices 5 distributed over the width of conveying rotor 3. The gripping devices have a first gripper arm 6 and a second gripper arm 7 which is trailing in the rotary direction D of conveying rotor 3. Both gripper arms 6, 7 are arranged on a shaft 9 so as to be pivotal around an axis 10 of shaft 9 and can be controlled into an open or closed position by a control device 101 as described below.

A magazine 11 is disposed approximately above conveying rotor 3, in which printed sheets 2 are stored together in the manner of a stack. The printed sheets rest on or against a magazine bottom 12 and opposite of controlled detaining pawls 13. According to FIG. 1, printed sheets 2 are resting with their fold against a side wall 14 of magazine 11.

A separating apparatus 15 is arranged below magazine bottom 12 and cooperates with detaining pawls 13 in the cadence of the conveying rotor 3. The separating apparatus partially lifts a bottom printed sheet 2 facing the separating apparatus from the stack of printed sheets 2 while detaining pawls 13 are pulled back.

The operation of gripping device 5 takes place by means of control device 101 which includes two control tracks, namely an inner control track 102 and an outer control track 103, arranged in a stationary manner around rotary axis 8 of conveying rotor 3. Inner control track 102 is associated with gripper arm 6 and outer control track 103 is associated with gripper arm 7.

A pinion 104 engages a tooth segment 106 that is pivotally seated on a pivot axis 105. Tooth segment 106 is fixedly connected to a lever arm 107, illustrated with a dash-dot line, which is provided with a roller 108 engaging control track 102 on the end facing away from tooth segment 106. The change in position of roller 108 occurring during a rotation around rotary axis 8 of conveying rotor 3 effects a movement of gripper arm 6, different positions of which are shown in FIGS. 2 to 5.

The operation of gripper arm 7 is accomplished by a lever arrangement or a lever transmission 109 articulated on gripper arm 7. For this purpose, a rod 110 connected with conveying rotor 3 forms a pivot axis for a two-armed lever 111 bent at a right angle, forming a knee, which lever is articulated to gripper arm 7 through one free end via a connecting bracket 112 and which, on the other free end, is provided with a cam roller 113 running in control track 103.

During rotation of conveying rotor 3, lever arrangement 109 moves gripper arm 7 into the positions illustrated is according to FIGS. 2 to 5.

A change in the closing movement of the gripping device can be accomplished by turning the control tracks, if these are arranged, for example, in a flange that is rotatable around rotary axis 8 of conveying rotor 3.

In the illustrated embodiment of FIG. 1, separating apparatus 15 comprises a pivoting suction apparatus 18 which is connected to a vacuum source (not shown).

The design and operation of apparatus 1 is explained below in greater detail by way of FIGS. 1 to 6, which show operating steps during the separation of printed sheets by means of the inventive feeder. In FIG. 1, gripper arrangement 4 is in an open position or state on a path to a region of transfer of printed sheets 2 to conveying rotor 3. The free ends of gripper arms 6, 7 of gripper arrangement 4, while in the open position, traverse paths 16, 17, which deviate from a circular rotary movement from the moment they are opened to a point of removal of a gripped printed sheet 2 from magazine 11. Furthermore, FIG. 1 shows the situation in which detaining pawl 13 have been removed from the first printed sheet 2 by a pivot movement, and suction apparatus 18 is in a process of placing one or several suction heads 19 onto the printed sheet in an edge region of printed sheet 2.

Suction apparatus 18 has a pivot axis 23 which is disposed approximately at the point where the magazine bottom 12 ends below the printed sheet 2 that is to be pulled off and it extends transversely to the conveying direction of printed sheets 2 to be pulled off. The suction apparatus 18 is secured on a pivotal shaft 24 (see FIG. 6) disposed in the pivot axis 23. Each suction head 19 of suction apparatus 18 is connected by means of a tube 21 (dash-dot line) to a vacuum line 20 extending parallel to pivot axis 23. Suction heads 19 are also respectively connected to shaft 24 by pivot arms 22.

Magazine bottom 12 ends approximately in a region of pivot axis 23 with a crimped edge that is gentle on printed sheets 2 during removal from the magazine. A printed sheet 2 gripped by separating apparatus 15 is pulled around the crimped edge. Magazine bottom 12 ending in the region of the pivot axis 23 forms a wide access for the suction apparatus 18 to printed sheets 2 in magazine 11 that are to be pulled off.

Figure 2:
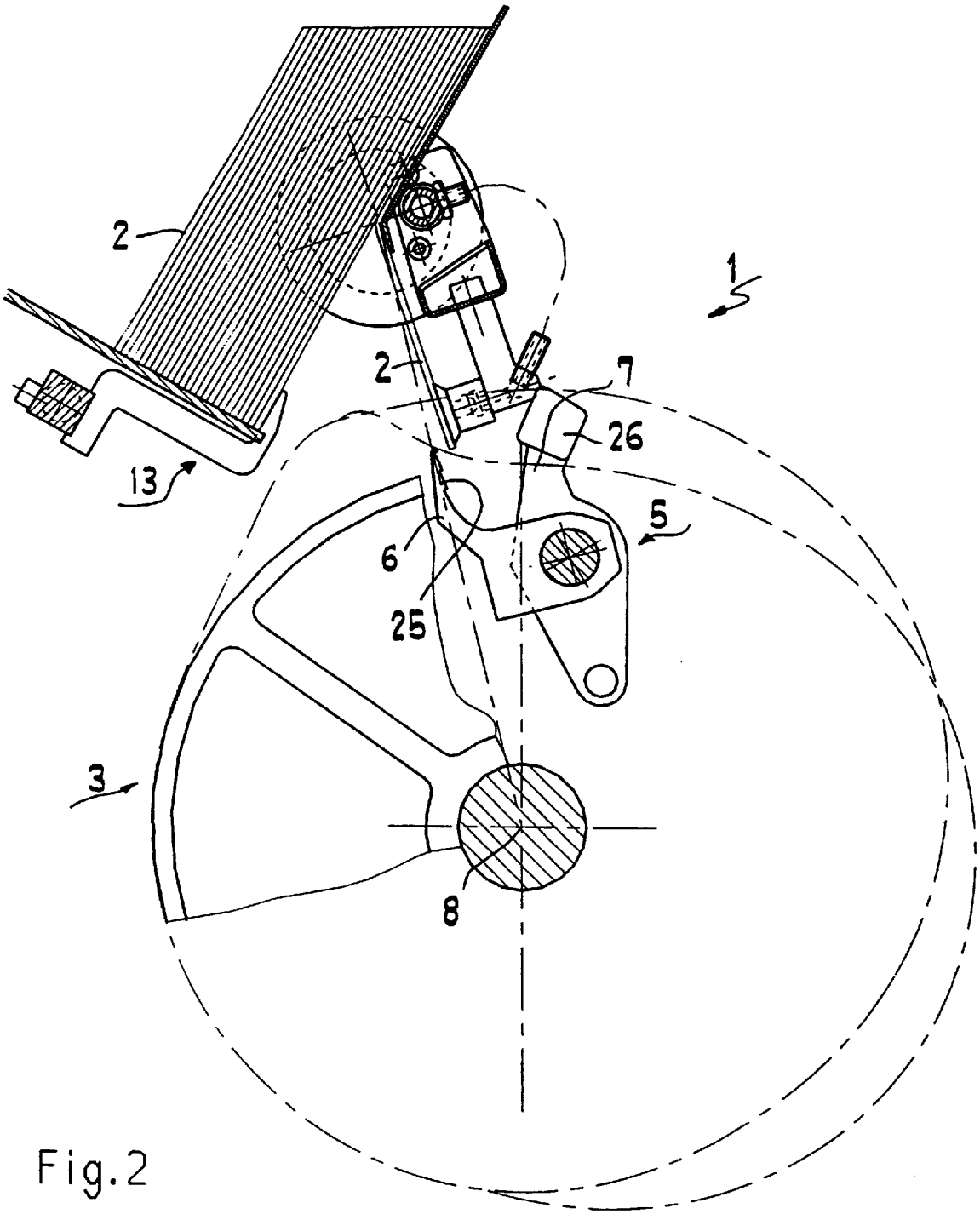
FIG. 2 is a schematic side view of the embodiment according to FIG. 1 in an advanced working position.

FIG. 2 shows the same apparatus 1 immediately before a printed sheet 2 is gripped by gripper arrangement 4. Here, the free end of printed sheet 2 to be pulled off, which is still held in magazine 11, has reached a position in the region of the transfer before the leading first gripper arm 6 of gripping device 5 that allows it to be disposed undisturbed between gripper arms 6, 7 which, on the path into the transfer region, are displaced radially outward from rotary axis 8. FIGS. 1 and 2 illustrate the paths of the free ends of gripper arms 6, 7. Gripper arm 6 leaves the orbit of conveying rotor 3 toward the outside in the transfer region to move into the closed position. In contrast to the illustration in FIG. 2, it would be conceivable to configure the gripping device 5 and its control so that first gripper arm 6 leaves the orbit of the conveying rotor 3 exclusively in the transfer region.

Once printed sheet 2 has been lifted off the stack, detaining pawls 13 have also returned to the operating position in which they hold the stack in magazine 11 over the access opening of separating apparatus 15.

Figure 3:
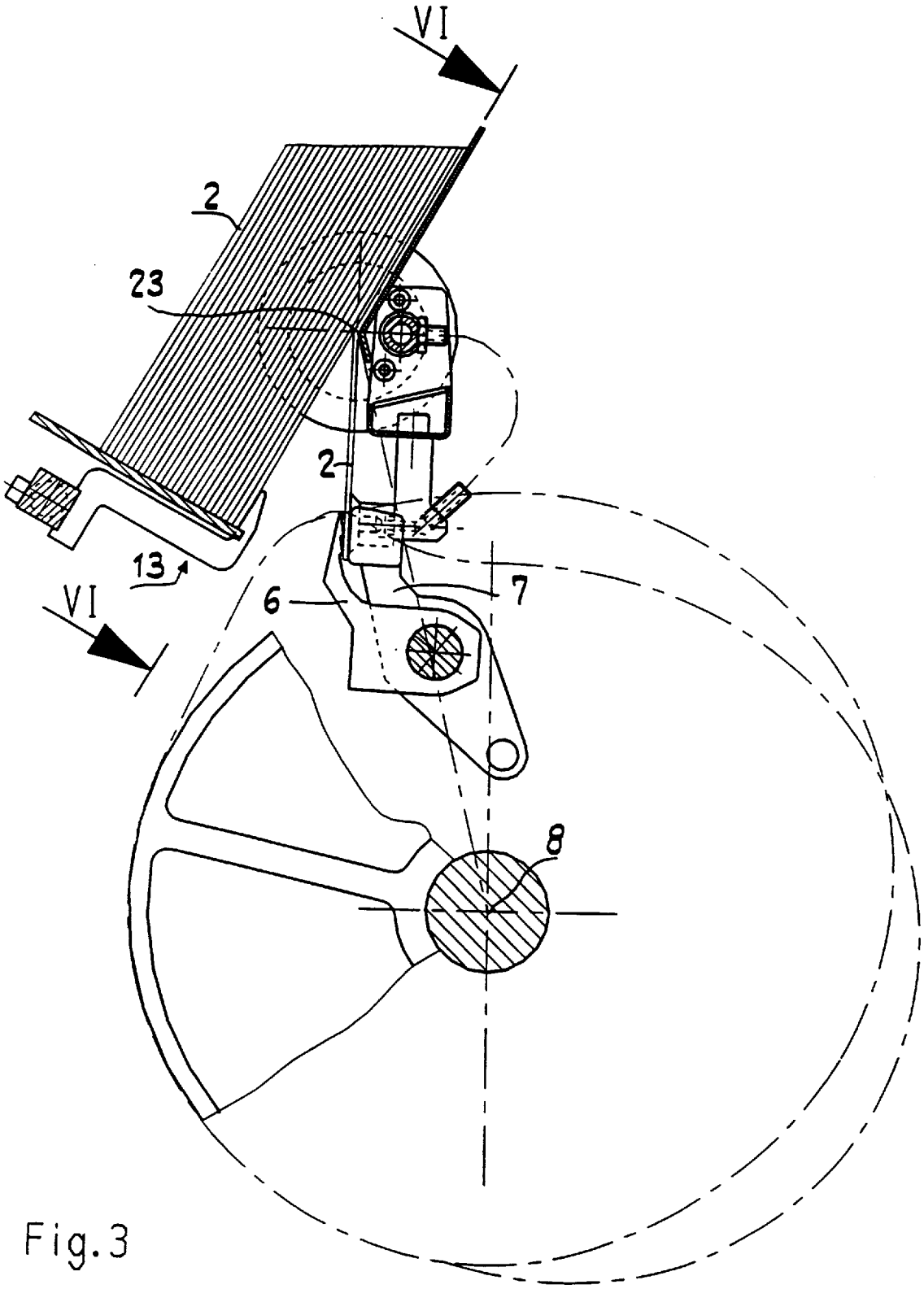
FIG. 3 is a schematic side view of the embodiment according to FIGS. 1 and 2 in a further advanced working position.

In FIG. 3, printed sheet 2 that was partially lifted off the stack is clamped in gripping device 5 between pressed-together clamping elements 25, 26 of gripper arms 6, 7 after the gripper arms have moved ahead into the closed position, while printed sheet 2 is captured by suction apparatus 18. Printed sheet 2 is freed from suction apparatus 18 in this position. On the joint path to the closed position, printed sheet 2 plunges more and more deeply into gripping devices 5. Gripper arms 6, 7 impact printed sheet 2 in the closed position without friction. In the closed position, gripper arms 6, 7 have reached the most outward position with respect to rotary axis 8 of conveying rotor 3.

From this point onward, the printed sheet section clamped in gripping device 5 forms a largely prolate (i.e. flat) plane up to the end of the magazine bottom, which plane extends over the entire printed sheet 2 until the sheet leaves the magazine 11. Thus, the printed sheet 2 can be pulled from under the stack without being damaged.

It should also be noted that the closed position of gripper arrangement 4 or of gripping devices 5, seen in the rotary direction D of the conveying rotor 3, is disposed approximately in the region of approachment behind a plane that is formed by the connection of the deflection axis of printed sheet 2 to be pulled off or the pivot axis 23 of the suction apparatus 18 and rotary axis 8 of conveying rotor 3.

Because of the different formats and grades of printed sheets, the geometry between the cooperating elements, namely gripping devices 5, separating apparatus 15, magazine bottom 12 and magazine 11, can be changed so that an optimum transfer of printed sheets 2 to conveying rotor 3 can be ensured. This adjustment and setting option is provided for the transfer region which is defined by the location of printed sheet 2 that was lifted off the stack and is positioned between the gripper arms 6, 7 of the open gripping device 5 and the closed position of the gripping devices 5 of gripper arrangement 4.

Figure 4:
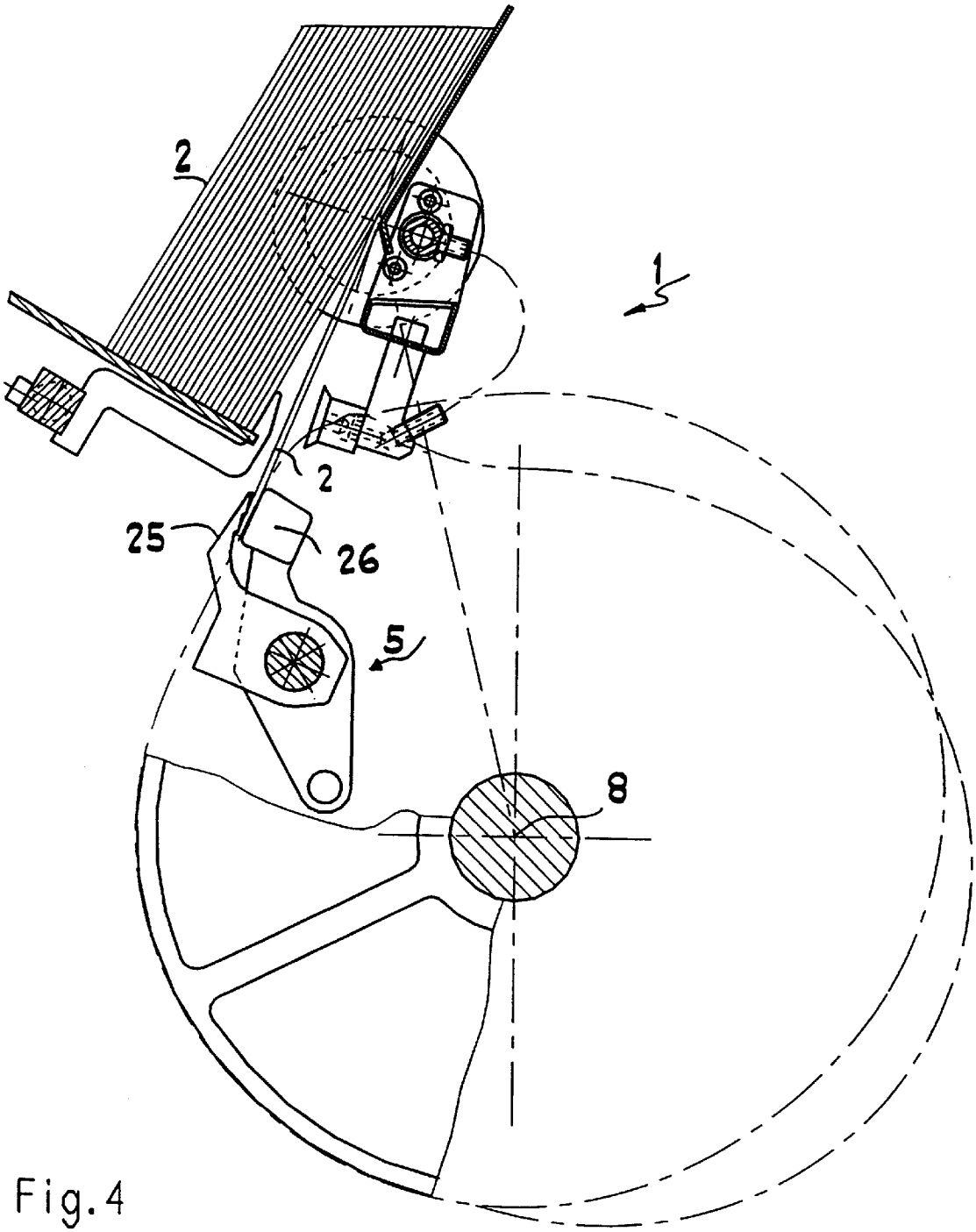
FIG. 4 is a schematic side view of the embodiment according to FIGS. 1 to 3 in an advanced working position.
Figure 5:
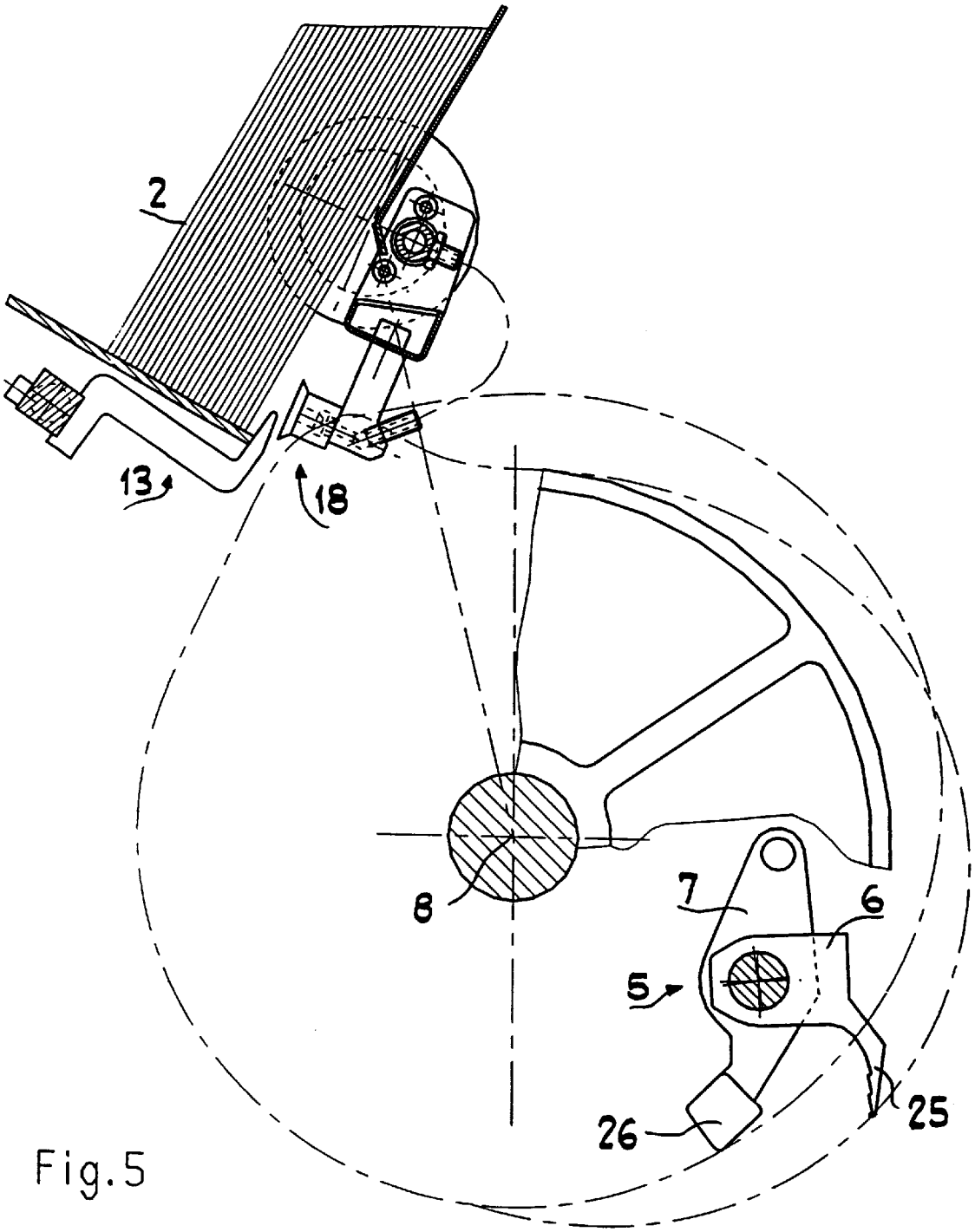
FIG. 5 is a schematic side view of the embodiment in a working position that is further advanced compared to the FIGS. 1 to 4.

FIG. 4 illustrates apparatus 1 in a situation where a printed sheet 2 has been partially pulled out from under the stack. Printed sheet 2 remains in a stretched state until it is removed entirely from the stack.

After approximately 180° following the transfer, gripping devices 5 are opened by actuating gripper arms 6, 7 for the discharge of printed sheets 2. The location of the opening region is determined by the mode with which the printed sheets 2 are further processed (see FIG. 5).

In the illustrated situation, gripping devices 5 are on the path to taking over another printed sheet 2 below the stack in magazine 11. Here, suction apparatus 18 and detaining pawls 13 are already activated for the lifting off of bottom printed sheet 2.

Figure 6:
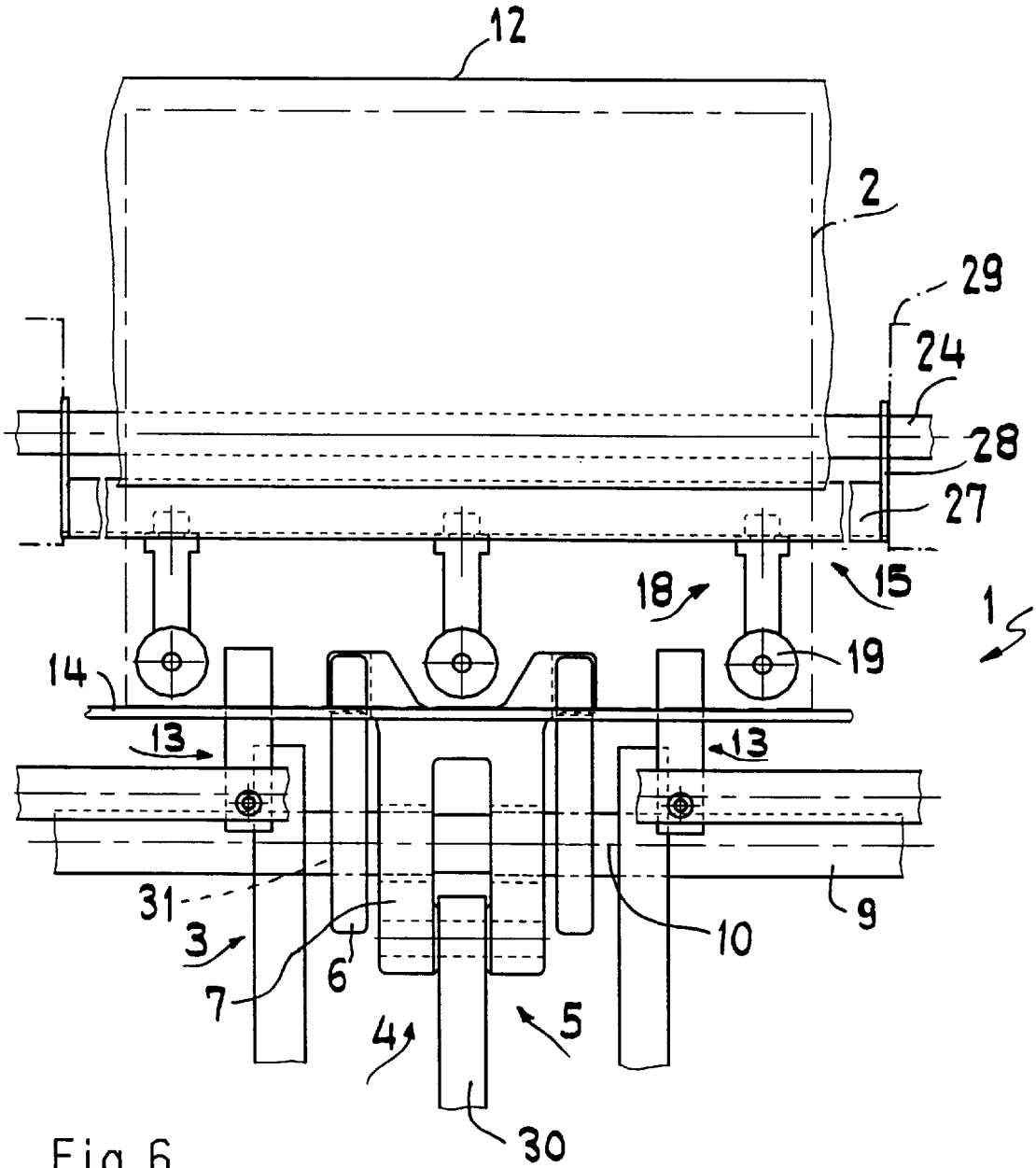
FIG. 6 is a section through the embodiment along the line VI—VI in FIG. 3.

By way of example, FIG. 6 shows the layout of the elements of apparatus 1 transversely to the rotary direction D of conveying rotor 3. Suction apparatus 18 is secured on a crossbeam 27 which, in turn, is connected to a control shaft 24 by screw-down brackets 28.

A vacuum line 20 is also fastened to brackets 28. Brackets 28 are connected to a control shaft 24 by means of a screw connection to flanges 29 that are fixedly connected to control shaft 24.

According to FIG. 6, gripper arrangement 4 is comprised of two gripping devices 5 of which, again because of the small distance, the two second gripper arms 7 that are pivotally seated on axis 10 are connected in a one-piece construction and are coupled to a drive lever 30 of a control device (not shown).

The first gripper arms 6, indicated by wedges 31, which are respectively associated with a second gripper arm 7, are connected to shaft 9 that is rotatable around axis 10, on which shaft the second gripper arms 7 are also seated in a pivotal manner. The operation of the first gripper arms 6 is effected by shaft 9 and a further control device on the side of conveying rotor 3 as described above.

Naturally, it is not imperative that the second gripper arms 7 be of a one-piece construction, and the suction apparatus 18 might also be configured to be adjustable with respect to the width of apparatus 1.

The invention has been described in detail with respect to preferred embodiments, and it will now be apparent from the foregoing to those skilled in the art that changes and modifications may be made without departing from the invention in its broader aspects, and the invention, therefore, as defined in the appended claims is intended to cover all such changes and modifications as fall within the true spirit of the invention.

What is claimed is:

1. An apparatus for charging a processing line with printed sheets, comprising:

a stack of printed sheets stored in a printed sheet magazine;

a separating apparatus adjacent to the magazine for partially lifting off a printed sheet from the stack, the partially lifted sheet having a leading edge;

a rotary driven conveying rotor having an axis and a direction of rotation and disposed downstream of the separating apparatus;

a gripper arrangement located radially outward from the axis of the conveying rotor and including a first gripper arm and a second gripper arm trailing the first gripper arm in the direction of rotation of the driven conveying rotor, the first and second gripper arms having open and closed positions; and means for controlling the gripper arms for taking over the printed sheet from the separating apparatus by gripping the leading edge of the printed sheet and then pulling the printed sheet from the adjacent printed sheet magazine and conveying the printed sheet in an approximately circular orbit of the conveying rotor, the means for controlling the gripper arms including:

a gripper shaft fixedly mounted to the conveying rotor;

an inner control track and an outer control track arranged in a stationary manner around the axis of the conveying rotor;

a first roller movably engaging said inner control track and rotating with the conveying rotor, said first roller being connected to a first lever arm fixedly connected to a tooth segment pivotally mounted on the conveying rotor;

a pinion fixedly connected to the first gripper arm and pivotally mounted to said gripper shaft and movably engaged and driven by said tooth segment whereby, during one rotation of the conveying rotor, as the first roller moves in the inner control track the first lever arm causes the tooth segment to pivot thereby moving the pinion and attached first gripper arm through a plurality of positions; and a second roller movably engaging the outer control track and rotating with the conveying rotor fixedly connected to a second lever arm having a first end and a second end, the first end of the second lever arm being pivotally mounted on the conveying rotor and the second end of the second lever arm being connected to the second gripper arm by an articulated joint whereby, during one rotation of the conveying rotor, as the second roller moves in the outer control track, the second lever arm pivots, thereby driving the second gripper arm to pivot through a plurality of positions about the gripper shaft such that the first and second gripper arms cooperate to locate the lifted printed sheet between them when in the open position and then the first and second gripper arms rotate to the closed position before the printed sheet is released by the separating apparatus and the gripper arms after closing being driven in the direction of the printed sheets in the magazine.

2. An apparatus according to claim 1, wherein the means for controlling the gripper arms drives the first and second gripper arms when in the closed position so that while the printed sheet is being pulled off the stack and out of the magazine, it forms an approximately flat plane.

3. An apparatus according to claim 1, wherein the conveying rotor has a radial speed and when the printed sheet is released by the separating apparatus, the gripper arms gradually accelerate the printed sheet to the radial speed of the conveying rotor.

4. An apparatus according to claim 1, wherein the separating apparatus includes at least one suction apparatus that is pivotal around an axis that is parallel to the rotary axis of the conveying rotor, and the suction apparatus is connectable to a vacuum source.

5. An apparatus according to claim 4, wherein the sheet magazine has a bottom region and a partial bottom that partially covers the bottom region of the sheet magazine and the printed sheet has a deflection axis defined by an end of the partial bottom of the sheet magazine, the suction apparatus has a pivot axis that is parallel to the deflection axis, and the pivot axis of the suction apparatus and the parallel deflection axis of the printed sheet are disposed approximately in a plane.

6. An apparatus according to claim 5, including a connecting plane defined by a connection of one of (1) the deflection axis of the printed sheet and (2) the pivot axis of the suction apparatus and the rotary axis of the conveying rotor; and wherein the controlling means controls the gripper arms so that they are closed, as they approach the connecting plane.

7. An apparatus according to claim 6, wherein a transfer region is defined between (1) a location of the gripper arms in which the lifted printed sheet is positioned between the gripper arms in the open position and (2) the closed position of the gripper arms.

8. An apparatus according to claim 7, wherein at least one of the connecting plane, the closed position of the gripper arms and the transfer region are adjustable.

9. An apparatus according claim 5, wherein the separating apparatus bends a portion of a deflected printed sheet into a plane that is defined by a connection between one of the deflection axis of the printed sheet and the pivot axis of the separating apparatus and the rotary axis of the conveying rotor.

10. An apparatus according to claim 7, wherein the conveying rotor includes a drum-shaped support, and the means for controlling the gripper arms controls the first gripper arm to move toward the conveying rotor before moving underneath the printed sheet that was lifted off the stack and, subsequently, in the adjoining transfer region, the first gripper arm is controlled to move radially outwardly into the closed position of the gripper arrangement formed with the second gripper arm so that a reliable take-over by the gripper arrangement is ensured.

11. An apparatus according to claims 10, wherein the printed sheet, as it is pulled out of the magazine by the gripper arms, extends approximately tangentially with respect to the drum-shaped support of the conveying rotor.

* * * * *